US008403318B2

(12) United States Patent
Shiraishi

(10) Patent No.: US 8,403,318 B2
(45) Date of Patent: Mar. 26, 2013

(54) APPARATUS FOR DETECTING AMOUNT OF REMAINING SHEETS AND IMAGE FORMING APPARATUS INCLUDING THE SAME

(75) Inventor: Satoru Shiraishi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 770 days.

(21) Appl. No.: 12/566,182

(22) Filed: Sep. 24, 2009

(65) Prior Publication Data

US 2010/0074637 A1 Mar. 25, 2010

(30) Foreign Application Priority Data

Sep. 25, 2008 (JP) ..... P2008-246218

(51) Int. Cl.

| | |
|---|---|
| ***B65H 7/02*** | (2006.01) |
| ***B65H 7/08*** | (2006.01) |
| ***B65H 1/08*** | (2006.01) |
| ***B65H 1/18*** | (2006.01) |

(52) U.S. Cl. ..... 271/31; 271/110; 271/130; 271/152

(58) Field of Classification Search ..... 271/9.03, 271/31, 110, 130, 152, 145; 221/4, 6

See application file for complete search history.

(56) References Cited

U.S. PATENT DOCUMENTS

| | | | | |
|---|---|---|---|---|
| 5,700,003 | A * | 12/1997 | Sung | 271/110 |
| 7,971,870 | B2 * | 7/2011 | Lee et al. | 271/145 |
| 2005/0236760 | A1 * | 10/2005 | Kang | 271/152 |

FOREIGN PATENT DOCUMENTS

| | | | |
|---|---|---|---|
| JP | 2-110028 | A | 4/1990 |
| JP | 05-097278 | | 4/1993 |
| JP | 08-026527 | | 1/1996 |
| JP | 2001-335186 | A | 12/2001 |
| JP | 2002-347985 | | 12/2002 |
| JP | 2003-237985 | A | 8/2003 |
| JP | 2005-082343 | | 3/2005 |

OTHER PUBLICATIONS

Japanese Office Action dated Nov. 20, 2012 issued by the Japanese Patent Office in corresponding Japanese Patent Application No. 2008-246218.

* cited by examiner

*Primary Examiner* — David H Bollinger
(74) *Attorney, Agent, or Firm* — Sughrue Mion, PLLC

(57) ABSTRACT

A mechanism for detecting an amount of remaining sheets, includes: a sheet feeding tray to be accommodated in an apparatus main body such that the sheet feeding tray can be inserted into and withdrawn from the apparatus main body, in which sheets can be loaded in an inside of the sheet feeding tray; a tilting plate that is tiltably provided in the sheet feeding tray so as to tilt in accordance with an amount of remaining sheets in the sheet feeding tray; a rotating member that rotates between a starting end position and a final end position of rotation of the rotating member in association with the tilting of the tilting plate; and a locking mechanism that locks the rotation of the rotating member.

11 Claims, 9 Drawing Sheets

(FIRST EXEMPLARY EMBODIMENT)

(FIRST EXEMPLARY EMBODIMENT)

FIG. 2 (FIRST EXEMPLARY EMBODIMENT)

(FIRST EXEMPLARY EMBODIMENT)

(FIRST EXEMPLARY EMBODIMENT)

(FIRST EXEMPLARY EMBODIMENT)

(FIRST EXEMPLARY EMBODIMENT)

FIG. 7 (SECOND EXEMPLARY EMBODIMENT)
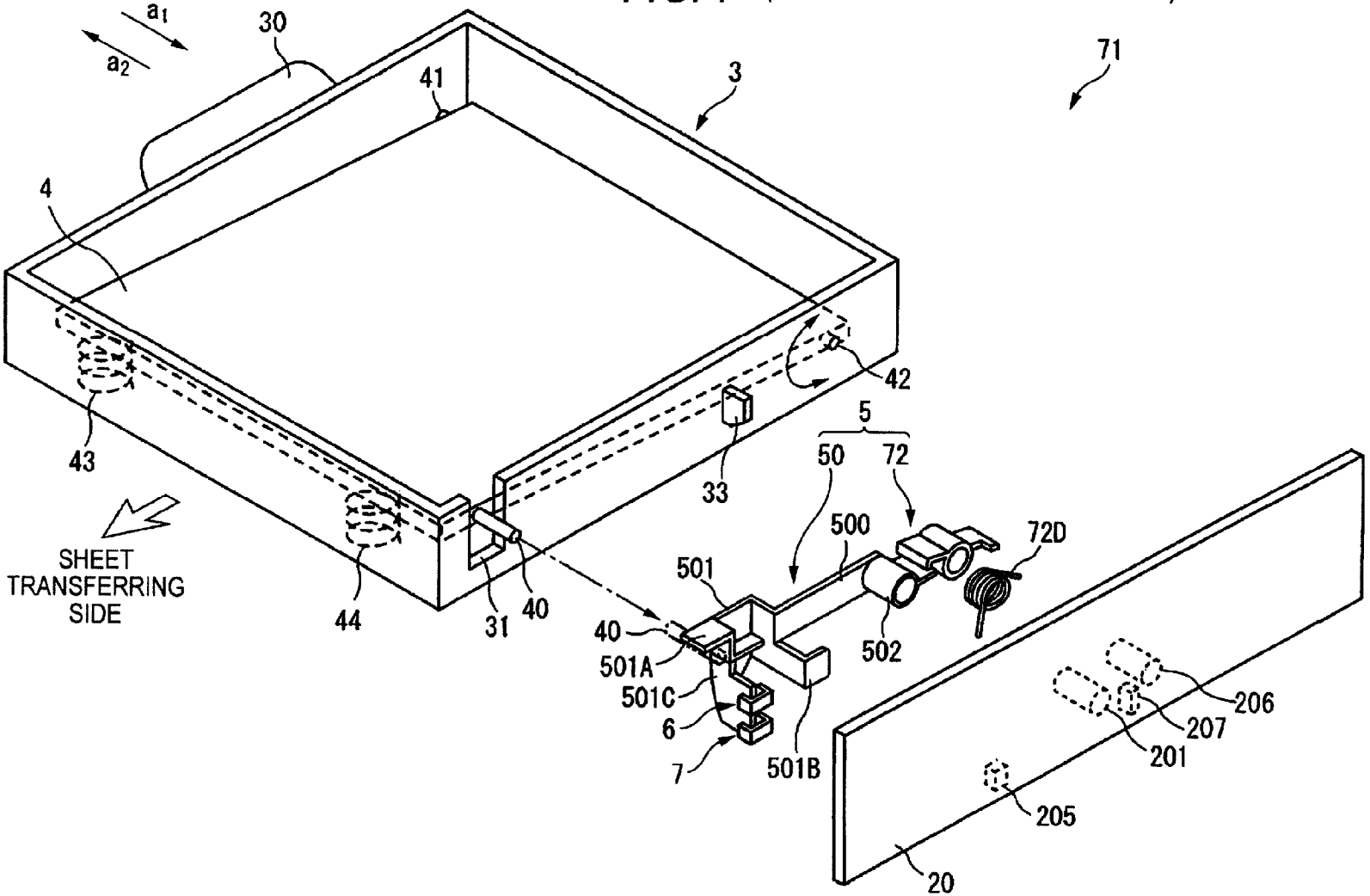

(SECOND EXEMPLARY EMBODIMENT)

(SECOND EXEMPLARY EMBODIMENT)

APPARATUS FOR DETECTING AMOUNT OF REMAINING SHEETS AND IMAGE FORMING APPARATUS INCLUDING THE SAME

CROSS-REFERENCE TO RELATED APPLICATION

This application is based on and claims priority under 35 DSC 119 from Japanese patent Application No. 2008-246218 filed Sep. 25, 2008.

BACKGROUND

Technical Field

The present invention relates to an apparatus for detecting the amount of the remaining sheets and an image forming apparatus including the same.

SUMMARY

According to an aspect of the invention, there is provided a mechanism for detecting an amount of remaining sheets, including:

a sheet feeding tray to be accommodated in an apparatus main body such that the sheet feeding tray can be inserted into and withdrawn from the apparatus main body, in which sheets can be loaded in an inside of the sheet feeding tray;

a tilting plate that is tiltably provided in the sheet feeding tray so as to tilt in accordance with an amount of remaining sheets in the sheet feeding tray;

a rotating member that rotates between a starting end position and a final end position of rotation of the rotating member in association with the tilting of the tilting plate; and a locking mechanism that locks the rotation of the rotating member.

BRIEF DESCRIPTION OF THE DRAWINGS

Exemplary embodiments of the present invention will be described in detail based on the following figures, wherein:

FIG. 7 is an exploded perspective view illustrating an entire apparatus for detecting the amount of the remaining sheets according to a second exemplary embodiment of the present invention;

DETAILED DESCRIPTION

First Exemplary Embodiment

Figure 1:
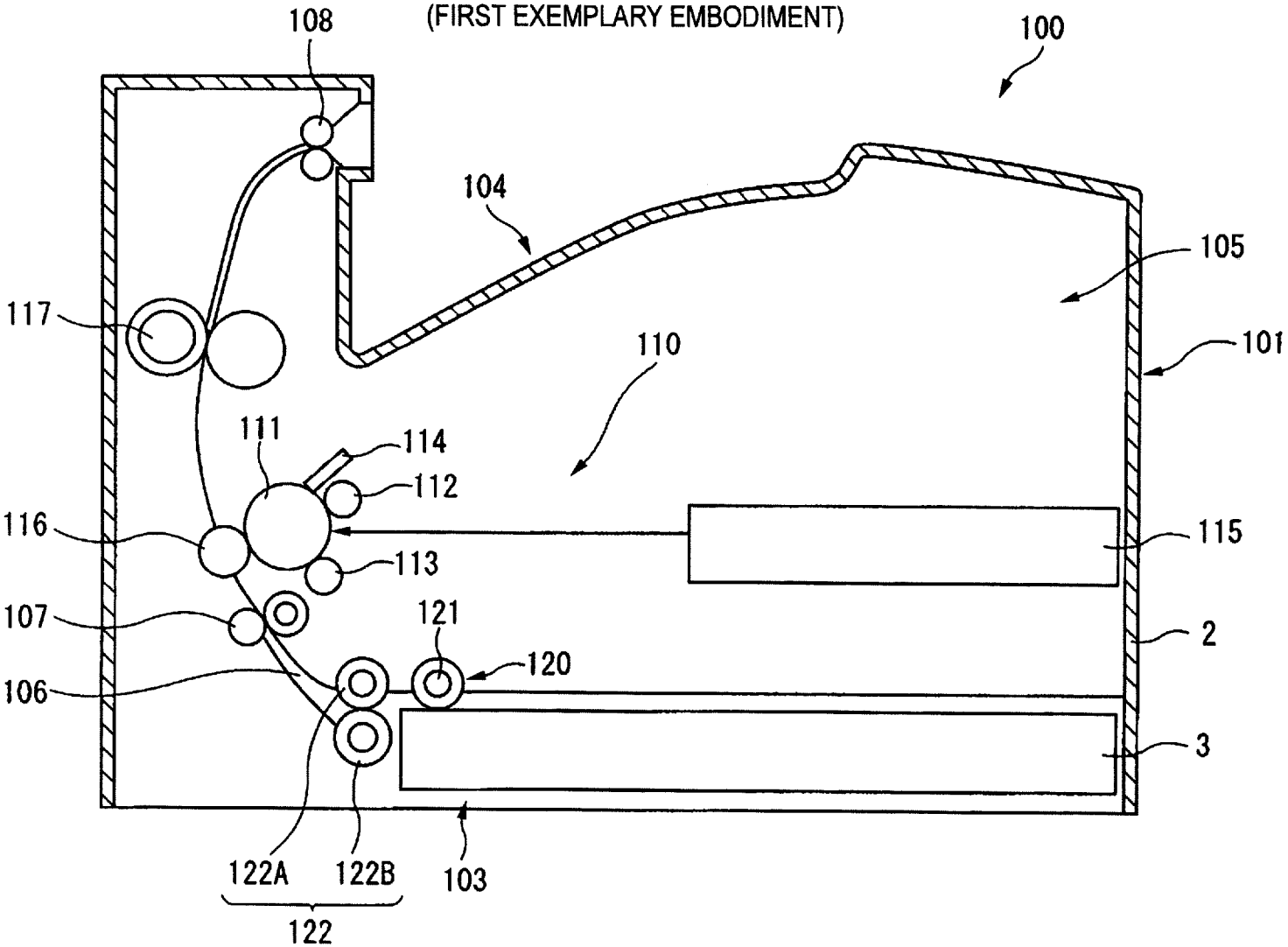
FIG. 1 is a cross-sectional view illustrating an entire image forming apparatus to which an apparatus for detecting the amount of the remaining sheets according to a first exemplary embodiment of the present invention is applied.

First, an image forming apparatus according to a first exemplary embodiment of the present invention will be described with reference to FIG. 1. FIG. 1 is a cross-sectional view illustrating an entire image forming apparatus to which an apparatus for detecting the amount of the remaining sheets according to the first exemplary embodiment of the present invention is applied.

[Entire Structure of Image Forming Apparatus]

In FIG. 1, an image forming apparatus denoted by reference numeral 100 includes a case 101 so that an image forming unit 110 and a sheet supplying unit 103 are built in the case 101 and is applied to, for example, a copying machine.

(Structure of Case 101)

As illustrated in FIG. 1, the top of the case 101 is used as a discharge tray 104. In the case 101, an accommodating space 105 for accommodating the image forming unit 110 and the sheet supplying unit 103 and a sheet conveying path 106 for leading the sheets supplied from the sheet supplying unit 103 to the image forming unit 110 and the discharge tray 104 are provided.

(Structure of Image Forming Unit 110)

The image forming unit 110 is formed of, for example, an electro-photographic type image forming apparatus includes a photosensitive drum 111 as an image carrier, a charging unit 112 for charging the photosensitive drum 111, a developing unit 113 for visualizing the electrostatic latent image formed on the photosensitive drum 111 by a toner, a cleaning unit 114 for cleaning the toner that resides on the photosensitive drum 111, an exposing unit 115 formed of a laser scanning apparatus for writing down the electrostatic latent image in the photosensitive drum 111 uniformly charged by the charging unit 112 by light, a transferring unit 116 formed of, for example, a transferring roll for transferring the toner image formed on the photosensitive drum 111 to a sheet, and a fixing unit 117 for fixing the toner image transferred by the transferring unit 116 to the sheet, is provided above the sheet supplying unit 103, and is accommodated in the accommodating space 105.

On the sheet conveying path 106, a resist roll 107 for determining the position of the sheet and for conveying the sheet is provided in the upstream of the photosensitive drum 111 and a discharge roll 108 that functions as a conveying member is provided around a discharge port together with the photosensitive drum 111, the transferring unit (transferring roll) 116, and the fixing unit 117.

Therefore, the position of the sheet supplied from the sheet supplying unit 103 is adjusted by the resist roll 107 of the sheet conveying path 106. Then, the sheet is conveyed to the image transferring part of the image forming unit 110 at a predetermined timing so that the image is transferred onto the sheet and is discharged to the discharge tray 104 through the fixing unit 117 by the discharge roll 108.

(Structure of Sheet Supplying Unit 103)

The sheet supplying unit 103 includes a sheet feeding tray 3 and a tilting plate 4 (illustrated in FIG. 2) that constitute a part of an apparatus 1 for detecting the amount of remaining sheets and a sheet transferring unit 120 provided in the sheet feeding tray 3, for transferring loaded sheets to the image forming unit 110 with the tilting plate 4 interposed, is provided below the image forming unit 110, and is accommodated in the accommodating space 105.

The sheet transferring unit 120 includes a pickup roll 121 for transferring the uppermost sheet among the sheets loaded on the tilting plate 4 and a sheet processing unit 122 consisting of a feed roll 122A for processing the sheets transferred by the pickup roll 121 one by one and a retard roll 122B and is provided on the sheet transferring side of the sheet feeding tray 3.

The pickup roll 121 is supported in a rotatable manner by the free end of a rocking plate (not shown) that rocks using the roll shaft of the feed roll 122A as a pivot shaft. The rocking plate is biased to the tilting plate 4 by a spring (not shown). Therefore, the pickup roll 121 is pressingly provided on the uppermost sheet by predetermined nip pressure.

In the sheet processing unit 122, the feed roll 122A and the retard roll 122B are provided in the positions where the feed roll 122A and the retard roll 122B can roll while contacting each other.

Figure 2:
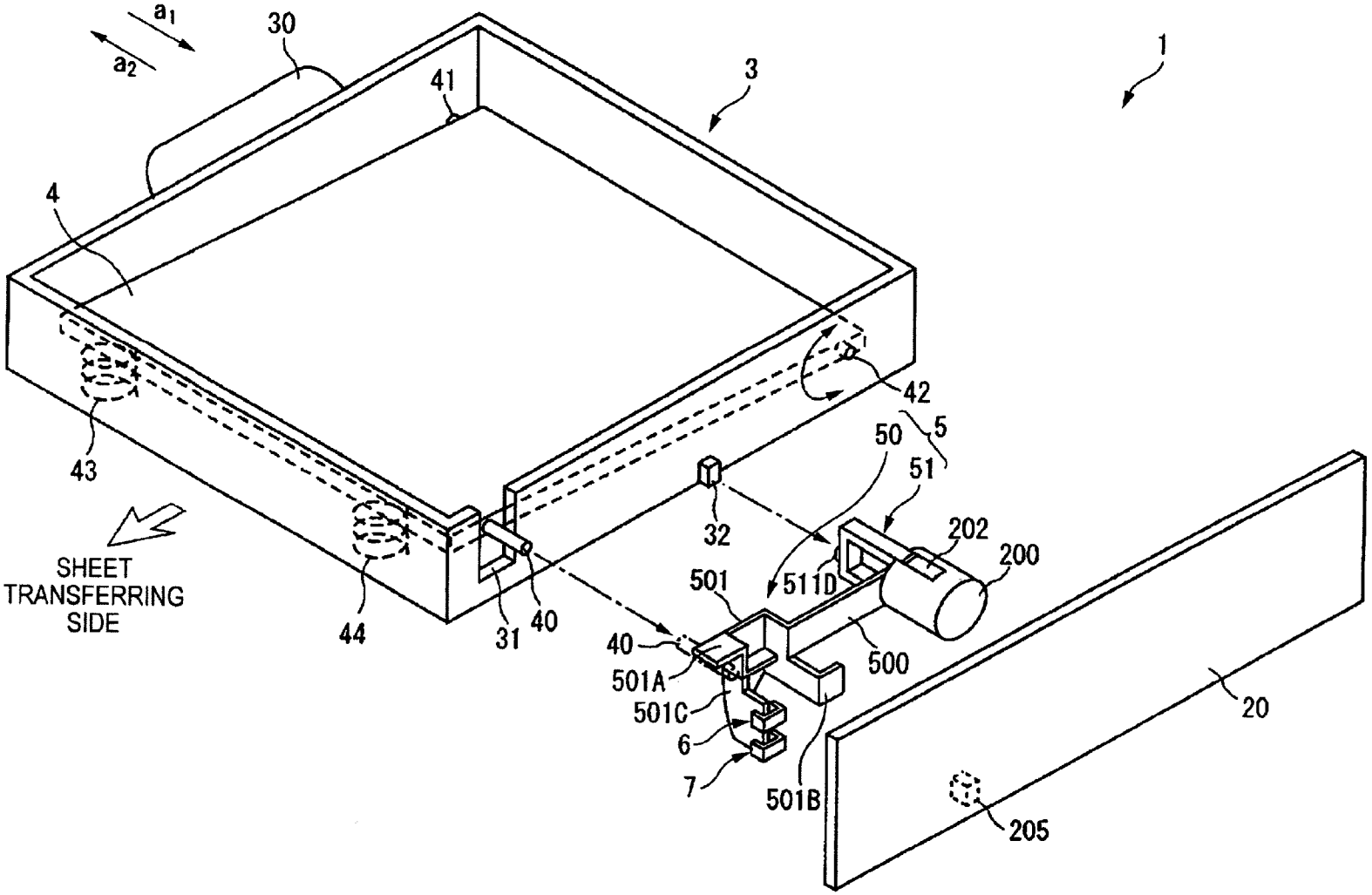
FIG. 2 is an exploded perspective view illustrating the entire apparatus for detecting the amount of the remaining sheets according to the first exemplary embodiment of the present invention.
Figure 3:
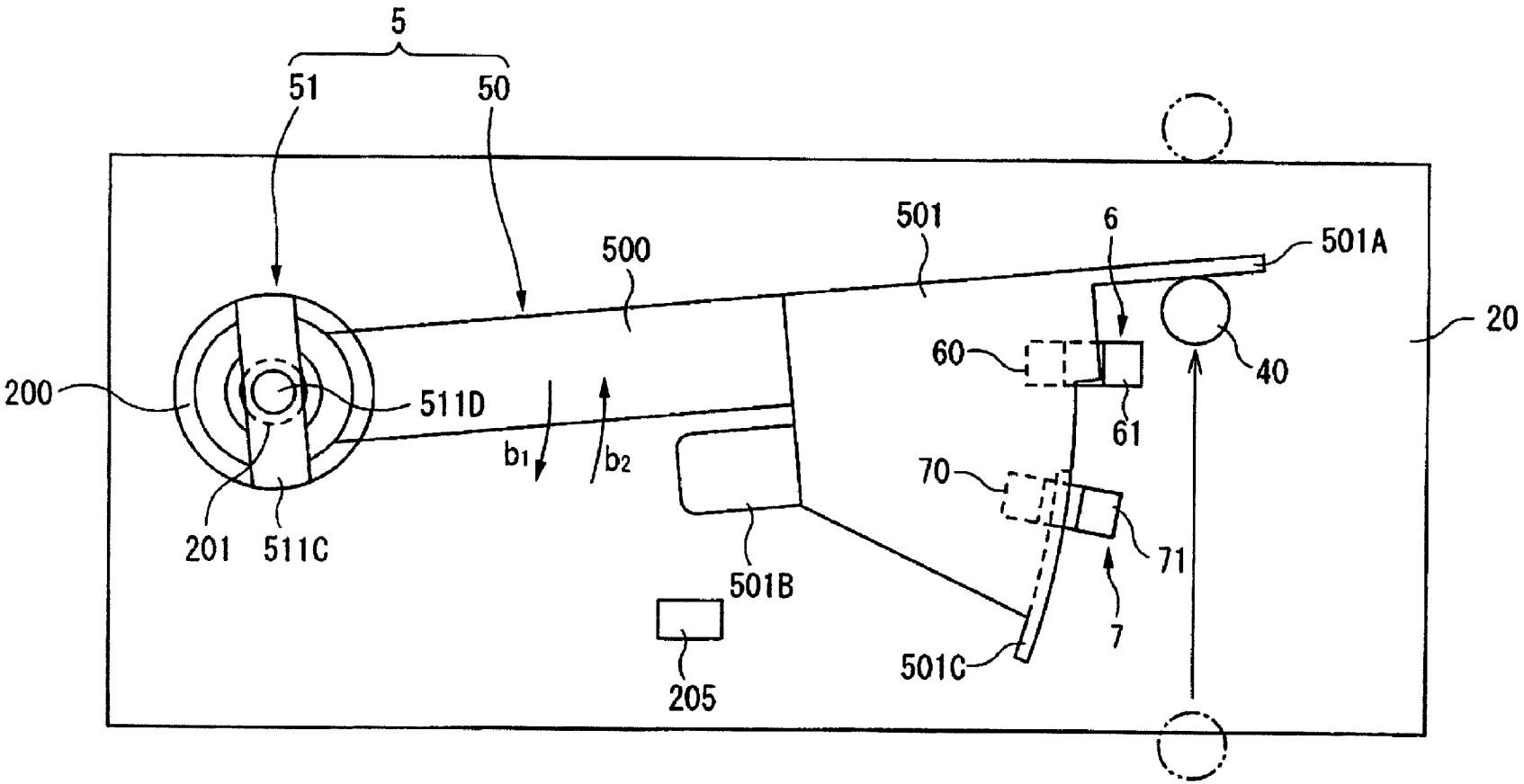
FIG. 3 is a front view illustrating the main parts of the apparatus for detecting the amount of the remaining sheets according to the first exemplary embodiment of the present invention.
Figure 4:
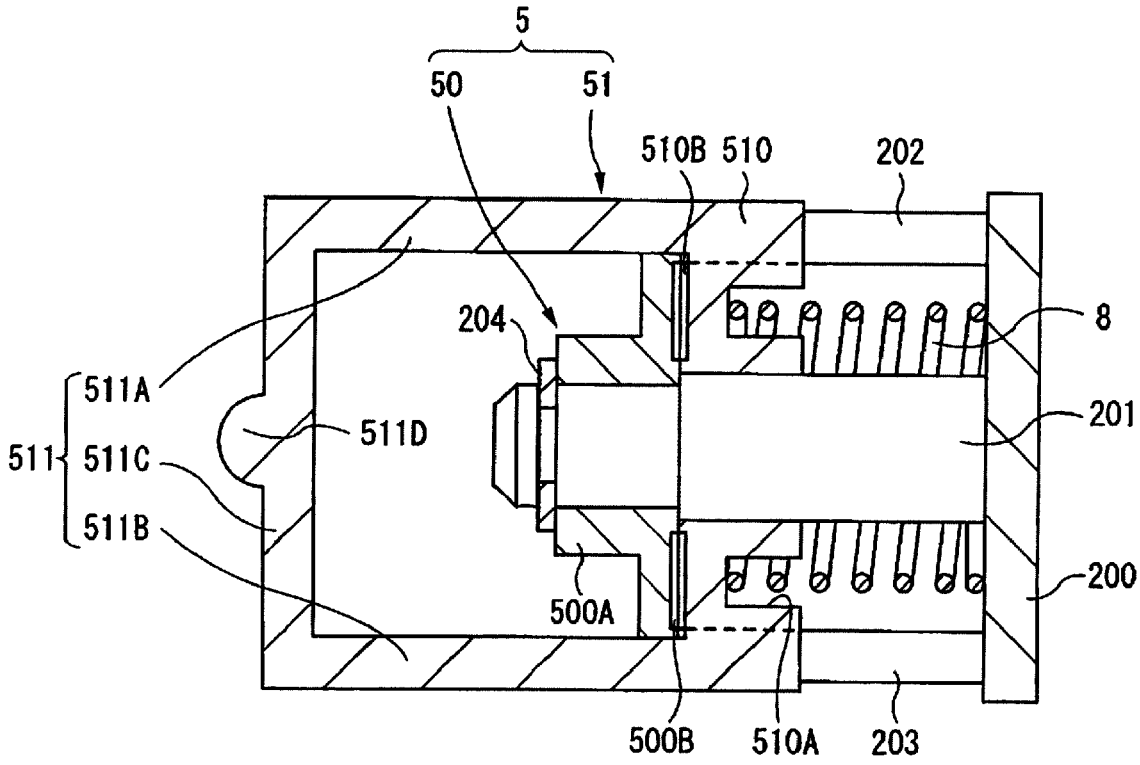
FIG. 4 is a cross-sectional view illustrating the main parts of the apparatus for detecting the amount of the remaining sheets according to the first exemplary embodiment of the present invention.

Next, the apparatus for detecting the amount of the remaining sheets according to the first exemplary embodiment of the present invention will be described with reference to FIGS. 1 to 4. FIG. 2 is an exploded perspective view illustrating the entire apparatus for detecting the amount of the remaining sheets according to the first exemplary embodiment of the present invention. FIG. 3 is a front view illustrating the main parts of the apparatus for detecting the amount of the remaining sheets according to the first exemplary embodiment of the present invention. FIG. 4 is a cross-sectional view illustrating the main parts of the apparatus for detecting the amount of the remaining sheets according to the first exemplary embodiment of the present invention. In addition, FIG. 4 illustrates a state in which a rotating link is locked.

(Entire Structure of Apparatus for Detecting Amount of Remaining Sheets 1)

As illustrated in FIG. 2, the apparatus 1 for detecting the amount of the remaining sheets includes an apparatus main body 2 (illustrated in FIG. 1) that forms a part of the case 101 in the image forming apparatus 100 (illustrated in FIG. 1), the sheet feeding tray 3 in which the sheets can be loaded, the tilting plate 4 that tilts in accordance with the amount of the remaining sheets in the sheet feeding tray 3, a link mechanism 5 that operates in association with the tilting of the tilting plate 4, and sensors 6 and 7 for detecting the amount of the remaining sheets from the position of the rotating link 50 of the link mechanism 5.

(Structure of Apparatus Main Body 2 of Apparatus)

As illustrated in FIG. 1, the apparatus main body 2 is provided below the case 101 in the image forming apparatus 100.

As illustrated in FIG. 2, in the apparatus main body 2, a mounting plate 20 whose front surface is almost rectangular is provided behind the link mechanism 5.

As illustrated in FIG. 3, at the edge of one side of the mounting plate 20, a cylindrical table 200 opened to the sheet feeding tray 3 and a supporting shaft 201 whose cross-section is almost T shaped and that protrudes from the center of the table 200 toward the sheet feeding tray 3 are provided.

As illustrated in FIG. 4, in the table 200, a pair of guide grooves 202 and 203 that run parallel with each other in a circumferential direction at an equal distance to guide the locking unit 51 of the link mechanism 5 along a shaft that runs parallel with the supporting shaft 201 are provided.

As illustrated in FIG. 4, the supporting shaft 201 is integrated with the table 200 and is formed of stair shaped members consisting of two large and small bodies whose external diameters are different from each other. A fixing ring 204 for controlling the movement of the rotating link 50 in the direction of the shaft is mounted in the supporting shaft 201.

As illustrated in FIG. 3, in the center of the mounting plate 20 in a width direction of the plate, a stopper 205 positioned at the edge below the plate to control the clockwise rotation of the rotation link 50 is provided.

(Structure of Sheet Feeding Tray 3)

As illustrated in FIG. 2, the sheet feeding tray 3 has a grip 30 that protrudes toward the front of the tray (direction in which the tray is withdrawn) on the front surface of the tray and is accommodated in the accommodating space 105 (illustrated in FIG. 1) of the apparatus main body 2 to be inserted and withdrawn in the directions of arrows $a_1$ and $a_2$. The entire sheet feeding tray 3 is formed of a rectangular parallelepiped box whose top is opened. As described above, the sheet feeding tray 3 is formed so that the sheets are loaded therein with the tilting plate 4 interposed.

A pin inserting unit 31 is provided on the rear surface of the sheet feeding tray 3 by forming a notch from the edge of the top of the tray on a sheet transferring side to the periphery of the edge of the bottom surface of the tray. Almost in the center of the rear surface of the sheet feeding tray 3 in a width direction, a convex part 32 that protrudes backward from the tray is integrated with the sheet feeding tray 3.

(Structure of Tilting Plate 4)

As illustrated in FIG. 2, the tilting plate 4 has a maintaining pin 40 that is inserted into and passes through the pin inserting unit 31 of the sheet feeding tray 3, is accommodated in the sheet feeding tray 3, and is tiltably provided between a tilting starting end and a tilting final end with supporting shafts 41 and 42 interposed between the front surface of the sheet feeding tray 3 and the rear surface of the tray on the opposite sheet transferring side. The locking to the sheet feeding tray 3 is released by the insertion of the sheet feeding tray 3 into the apparatus main body 2. Therefore, the tilting plate 4 is tilted back to the tilting starting end by the withdrawal of the sheet feeding tray 3 from the apparatus main body 2 and is locked to the sheet feeding tray 3 in the tilting starting end so that the tilting plate 4 is tilted from the tilting starting end to the tilting final end by the elastic force of springs 43 and 44. In this case, in a state where the sheet feeding tray 3 is inserted into the apparatus main body 2, the tilting plate 4 is provided in a tilting position (a position between the tilting starting end and the tilting final end) in accordance with the amount of the remaining sheets.

The springs 43 and 44 that run parallel with each other on the sheet transferring side in the back and forth direction of the tray at a predetermined distance are elastically mounted between the edge on the sheet transferring side of the tilting plate 4 and the bottom surface of the sheet feeding tray 3.

(Structure of Link Mechanism 5)

As illustrated in FIG. 3, the link mechanism 5 includes the rotating link 50 as a rotating member and the locking unit 51 as a locking member and is provided on the mounting plate 20 (illustrated in FIG. 2).

As illustrated in FIG. 3, the rotating link 50 includes a link base piece 500 and a link weight piece 501. The link base piece 500 is rotatably connected to the mounting plate 20 with the supporting shaft 201 interposed. The link weight piece 501 is maintainably provided in the maintaining pin 40 of the tilting plate 4 with a contact force receiving unit 501A interposed therebetween. When the locking of the rotating link 50 by the locking unit 51 is released, the rotating link 50 is rotated by the deadweight from a rotation final end to a rotation starting end in association with the tilting of the tilting plate 4 around the supporting shaft 201 in the directions of arrows $b_1$ and $b_2$.

As illustrated in FIG. 4, the link base piece 500 has a connecting unit 500A whose cross-section is almost T shaped to insert the supporting shaft 201. The entire link base piece 500 is formed of an arm shaped member. A ring shaped engaging unit 500B positioned on the side of the table 200 and connected in a circumferential direction is provided in the connecting unit 500A.

As illustrated in FIG. 3, the link weight piece 501 includes the contact force receiving unit 501A contacting the maintaining pin 40 of the tilting plate 4, a movement controller 501B corresponding to the stopper 205 of the mounting plate 20, and a shielding unit 501C for shielding light between the light emitting units 60 and 70 and the light receiving units 61 and 71 of the sensors 6 and 7 for detecting the amount of the remaining sheets, is integrated with the link base piece 500, and is formed of a member whose entire surface is almost fan shaped.

As illustrated in FIG. 4, the locking unit 51 includes a slider 510 and a pressing force receiving piece 511 and is provided to reciprocate around the supporting shaft 201. The locking unit 51 moves by the insertion of the sheet feeding tray 3 into the apparatus main body 2 and releases the locking of the rotating link 50. The locking unit 51 returns due to the withdrawal of the sheet feeding tray 3 from the apparatus main body 2 and locks the rotating link 50 in the rotation position corresponding to the position in which the sheet feeding tray 3 is withdrawn.

As illustrated in FIG. 4, a slider 510 is slidably accommodated in the table 200 along the supporting shaft 201. The entire slider 510 is formed of a circular plate shaped member. A ring shaped concave groove 510A opened to the bottom surface of the table 200 is provided in the slider 510. A returning spring 8 for biasing the locking unit 51 to the sheet feeding tray 3 is elastically mounted between the bottom of the concave groove 510A and the bottom surface of the table 200. In the slider 510, a friction force generating member 510B that faces the engaging unit 500B of the link base piece 500 and that is made of, for example, a foaming elastic member such as foaming elastomer (sponge elastomer) for generating friction force between the engaging unit 500B is mounted.

As illustrated in FIG. 4, the pressing force receiving piece 511 is formed of a member whose cross-section is almost U shaped and that includes a pair of rotation controllers 511A and 511B that run parallel with each other in the circumferential direction of the slider 510 at an equal distance and a connecting unit 5110 for connecting the pair of rotation controllers 511A and 511B on the side of the sheet feeding tray 3. The rotation controllers 511A and 511B are accommodated in concave grooves 202 and 203, respectively, so that parts of the rotation controllers 511A and 511B can slidably move while in contact. A pressing force receiving unit 511D that faces the convex part 32 of the sheet feeding tray 3 is integrated with the connecting unit 5110 to protrude.

(Structure of Sensors 6 and 7 for Detecting Amount of Remaining Sheets)

As illustrated in FIG. 3, the sensors 6 and 7 for detecting the amount of the remaining sheets are formed of transmissive optical sensors such as photo-interrupters having the light emitting units 60 and 70 and the light receiving units 61 and 71, run parallel with each other in the rotating plane of the rotating link 50 on an arc around the rotating center at a predetermined distance, and are mounted in the sheet feeding tray 3 of the mounting plate 20. The amount of the remaining sheets is detected in the ranges of 0 to 10 sheets, 10 to 25 sheets, 25 to 50 sheets, and 50 to 100 sheets from the rotation position of the rotating link 50 by a combination of four states of light shielding between the light emitting units 60 and 70 and the light receiving units 61 and 71 by the shielding unit 501C of the rotating link 50 and transmission of light between the light emitting units 60 and 70 and the light receiving units 61 and 71. For example, when light between the light emitting unit 60 and the light receiving unit 61 is shielded and light is transmitted between the light emitting unit 70 and the light receiving unit 71, the amount of the remaining sheets is detected in the range of 50 to 100 sheets. When light is transmitted between the light emitting units 60 and 70 and the light receiving units 61 and 71, the amount of the remaining sheets is detected in the range of 0 to 10 sheets. Reflective optical sensors can be used as the sensors 6 and 7 for detecting the amount of the remaining sheets.

(Operation of Apparatus 1 for Detecting Amount of Remaining Sheets)

Figure 5A:
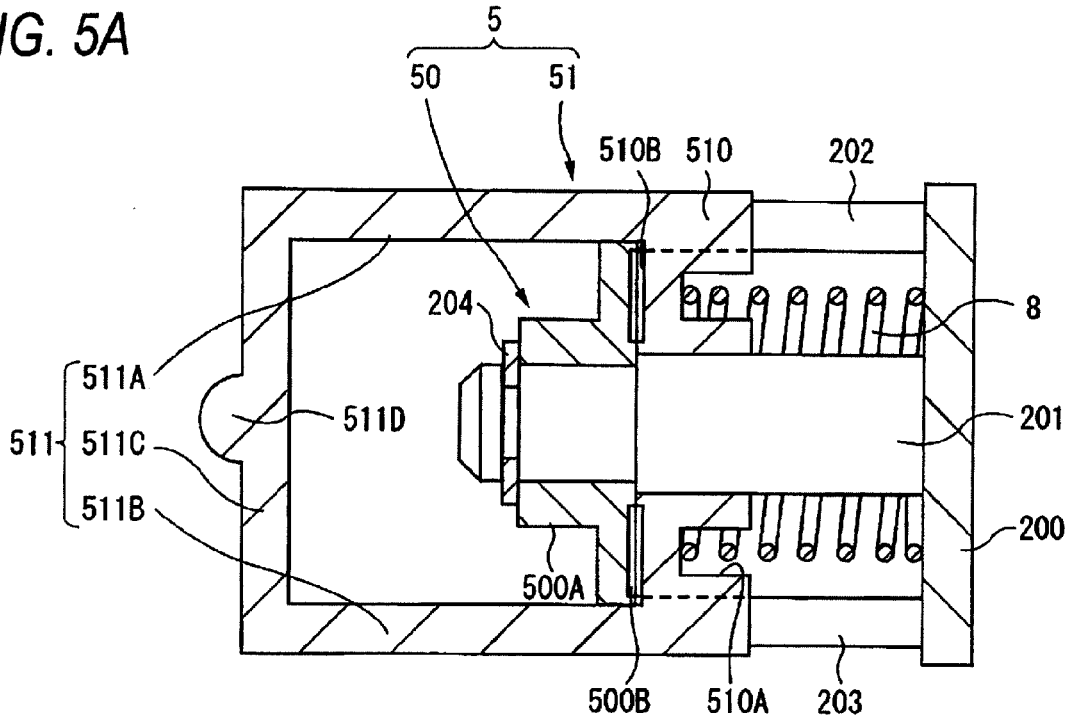
FIGS. 5A and 5B are cross-sectional views illustrating the operation of the apparatus for detecting the amount of the remaining sheets according to the first exemplary embodiment of the present invention.
Figure 5B:
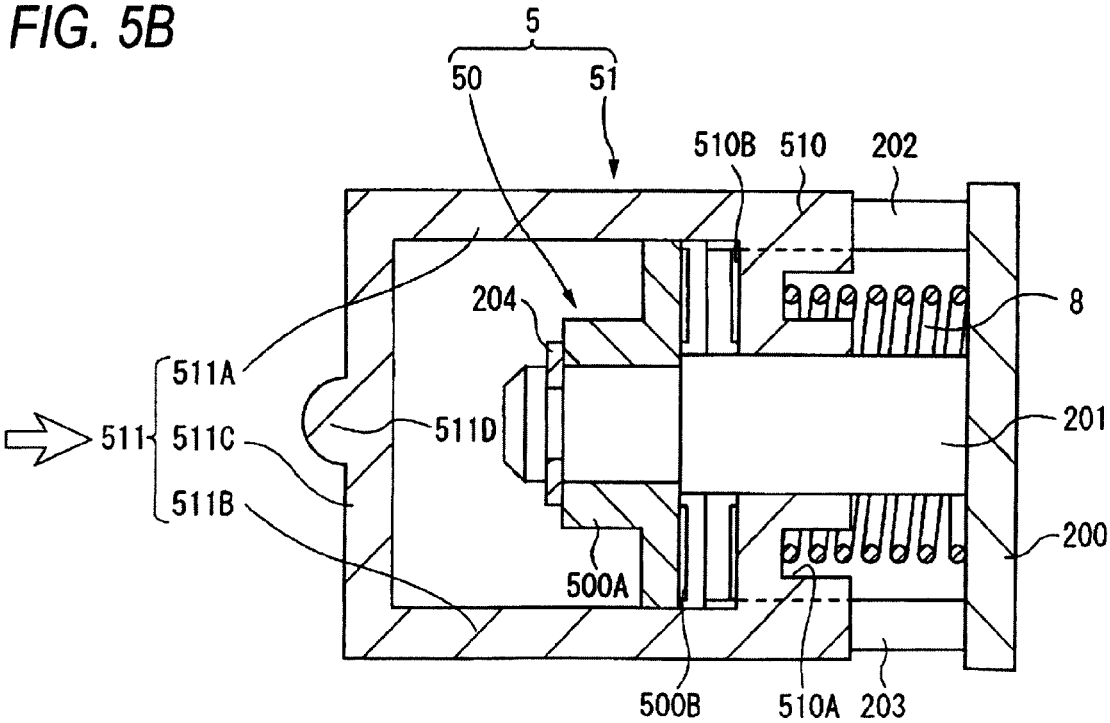
Figure 6A:
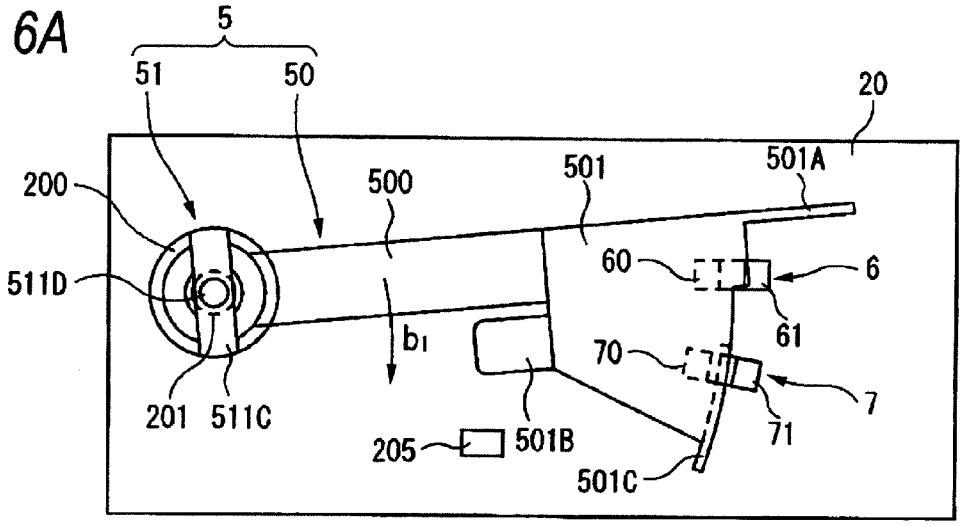
FIGS. 6A to 6C are front views illustrating the operation of the apparatus for detecting the amount of the remaining sheets according to the first exemplary embodiment of the present invention.
Figure 6B:
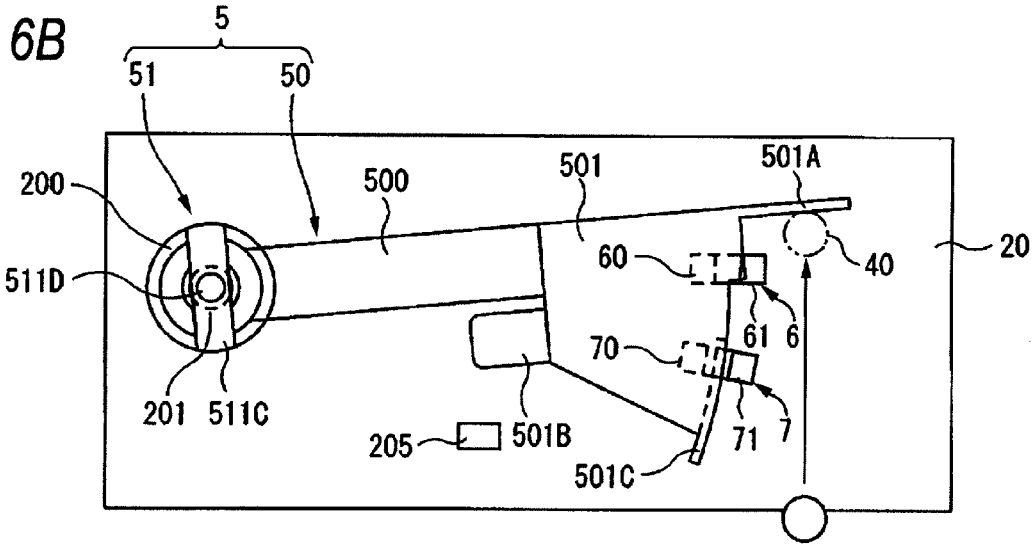
Figure 6C:
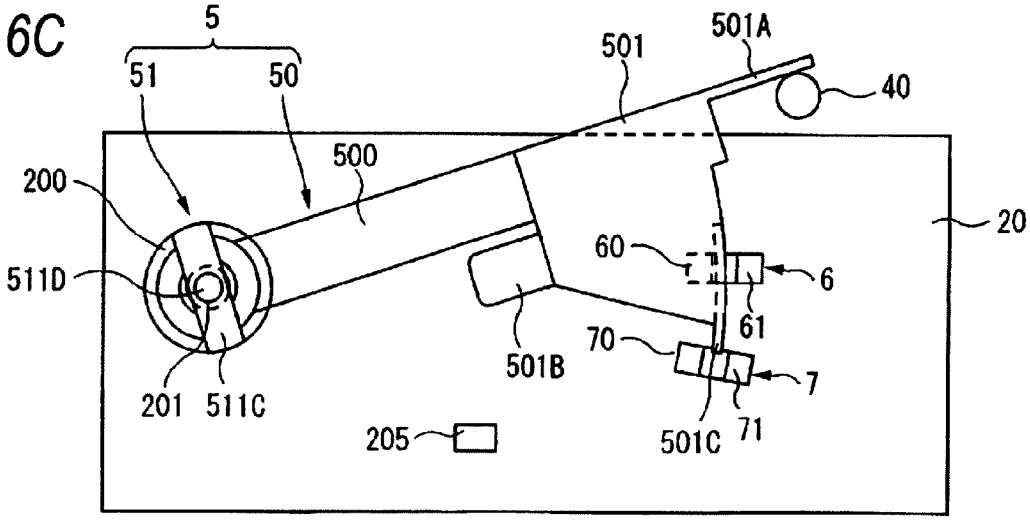

Next, the operation of the apparatus for detecting the amount of the remaining sheets according to the first exemplary embodiment of the present invention will be described with reference to FIGS. 2, 5A, 5B, and 6A to 6C. FIGS. 5A and 5B are cross-sectional views illustrating the operation of the apparatus for detecting the amount of the remaining sheets according to the first exemplary embodiment of the present invention. FIG. 5A illustrates a state in which the sheet feeding tray is withdrawn from the apparatus main body. FIG. 5B illustrates a state in which the sheet feeding tray is inserted into the apparatus main body. FIGS. 6A to 6C are front views illustrating the operation of the apparatus for detecting the amount of the remaining sheets according to the first exemplary embodiment of the present invention. FIG. 6A illustrates a state in which the sheet feeding tray is withdrawn from the apparatus main body. FIG. 63 illustrates a state immediately after the sheet feeding tray is inserted into the apparatus main body. FIG. 6C illustrates a state in which the sheet feeding tray is inserted into the apparatus main body.

The operation of the apparatus 1 for detecting the amount of the remaining sheets according to the present exemplary embodiment is divided into a case in which the sheet feeding tray is inserted into the apparatus main body and a case in which the sheet feeding tray is withdrawn from the apparatus main body to be described.

When the sheet feeding tray 3 is withdrawn from the apparatus main body 2, as illustrated in FIG. 5A, the engaging unit 500B of the link base piece 500 of the rotating link 50 is friction engaged with the friction force generating member 510B of the slider 510 of the locking unit 51 and, as illustrated in FIG. 6A, the rotating link 50 is provided between the rotation starting end and the rotation final end (the position in which the sheet feeding tray 3 is withdrawn from the apparatus main body 2). When the sheet feeding tray 3 is inserted into the apparatus main body 2, a friction engagement state between the engaging unit 500B of the link base piece 500 of the rotating link 50 and the friction force generating member 510B of the slider 510 of the locking unit 51 is released as illustrated in FIG. 5B and the rotating link 50 is maintained by the maintaining pin 40 of the tilting plate 4 as illustrated in FIG. 6C.

(Case in which Sheet feeding Tray is Inserted into Apparatus Main Body)

When the sheet feeding tray 3 is inserted into the apparatus main body 2, the convex part 32 moves in the insertion direction together with the sheet feeding tray 3 to press the pressing force receiving unit 511D of the locking unit 51 and, due to the pressure, the slider 510 of the locking unit 51 moves as illustrated in FIG. 5B from the initial (returning) position illustrated in FIG. 5A against the elastic force of the returning spring 8. In this case, due to the movement of the slider 510, the friction force generating member 510E is separated from the engaging unit 500B of the rotating link 50 and the friction engagement state between the engaging unit 500B and the friction force generating member 510E is released. Therefore, the rotating link 50 is rotated in a clockwise direction (the direction of the arrow $b_1$) from the position illustrated in FIG. 6A around the supporting shaft 201 by the deadweight.

When the sheet feeding tray 3 is inserted into the apparatus main body 2, as illustrated in FIG. 6B, the maintaining pin 40 of the tilting plate 4 moves to be provided below the contact force receiving unit 501A of the rotating link 50 and the locking between the tilting plate 4 and the sheet feeding tray 3 by the locking unit (not shown) is released. Therefore, the tilting plate 4 is tilted from the tilting starting end to the tilting final end by the elastic force of the springs 43 and 44. Accompanying the tilting, as illustrated in FIG. 6B, the maintaining pin 40 rises from the position illustrated in FIG. 6B by a solid line to the position illustrated in FIG. 6B by a two-dot chain line to contact the contact force receiving unit 501A of the rotating link 50. As illustrated in FIG. 6C, the tilting plate 4 tilts more from a contact starting position in which the tilting plate 4 contacts the contact force receiving unit 501A to a tilting final end while maintaining the contact state of the maintaining pin 40 and maintains the rotating link 50 in a tilting position in accordance with the amount of the remaining sheets in the sheet feeding tray 3.

(Case in which Sheet feeding Tray is Withdrawn from Apparatus Main Body)

When the sheet feeding tray 3 is withdrawn from the apparatus main body 2, the convex part 32 moves in the withdrawal direction together with the sheet feeding tray 3. Accompanying the above, the pressing of the locking unit 51 against the pressing force receiving unit 511D by the convex part 32 is released and the slider 510 of the locking unit 51 is returned from the moving position illustrated in FIG. 5B to the initial (returning) position by the elastic force of the returning spring 8 as illustrated in FIG. 5A. In this case, the friction force generating member 510B is moved toward the engaging unit 500B of the rotating link 50 by the returning of the slider 510 and the engaging unit 500B is friction engaged with the friction force generating member 510B. Therefore, as illustrated in FIG. 6A, the rotating link 50 is maintained in the rotation position corresponding to the position in which the engaging unit 500B is friction engaged with the friction force generating member 510B. That is, the rotating link 50 is maintained in the rotation position corresponding to the position in which the sheet feeding tray 3 is withdrawn from the apparatus main body 2. For example, even when the sheet feeding tray 3 is withdrawn from a state in which the sheet feeding tray 3 is inserted into the insertion end (sheet feeding) position of the apparatus main body 2 to the position before withdrawal ends and then, the sheet feeding tray 3 is again inserted into the insertion end of the apparatus main body 2, the maintaining pin 40 of the tilting plate 4 is provided below the contact force receiving unit 501A of the rotating link 50, so that the rotating link 50 can be firmly maintained by the maintaining pin 40 and so that it is possible to correctly detect the amount of the remaining sheets.

When the sheet feeding tray 3 is withdrawn from the apparatus main body 2, the tilting plate 4 is tilted back from the tilting position to the tilting starting end by a cam unit (not shown) against the elastic force of the springs 43 and 44. Accompanying the above, the maintaining pin 40 falls to release the contact to the rotating link 50. When the maintaining pin 40 is caused to fall more by the tilting back of the tilting plate 4 to be provided in the returning position illustrated in FIG. 6B by a solid line, the tilting plate 4 tilts back to the tilting starting end to be locked to the sheet feeding tray 3 by the locking unit (not shown).

In the apparatus 1 for detecting the amount of the remaining sheets having the above structure, since the sensors 6 and 7 for detecting the amount of the remaining sheets and the rotating link 50 are provided in the mounting plate 20 of the apparatus main body 2, for example, in comparison with a case in which the rotating link is mounted in the sheet feeding tray and a case in which the sensors for detecting the amount of the remaining sheets are mounted in the apparatus main body, the degree of precision in the relative position among the shielding unit 5010 of the rotating link 50 and the sensors 6 and 7 for detecting the amount of the remaining sheets can be relaxed.

Second Exemplary Embodiment

Figure 8:
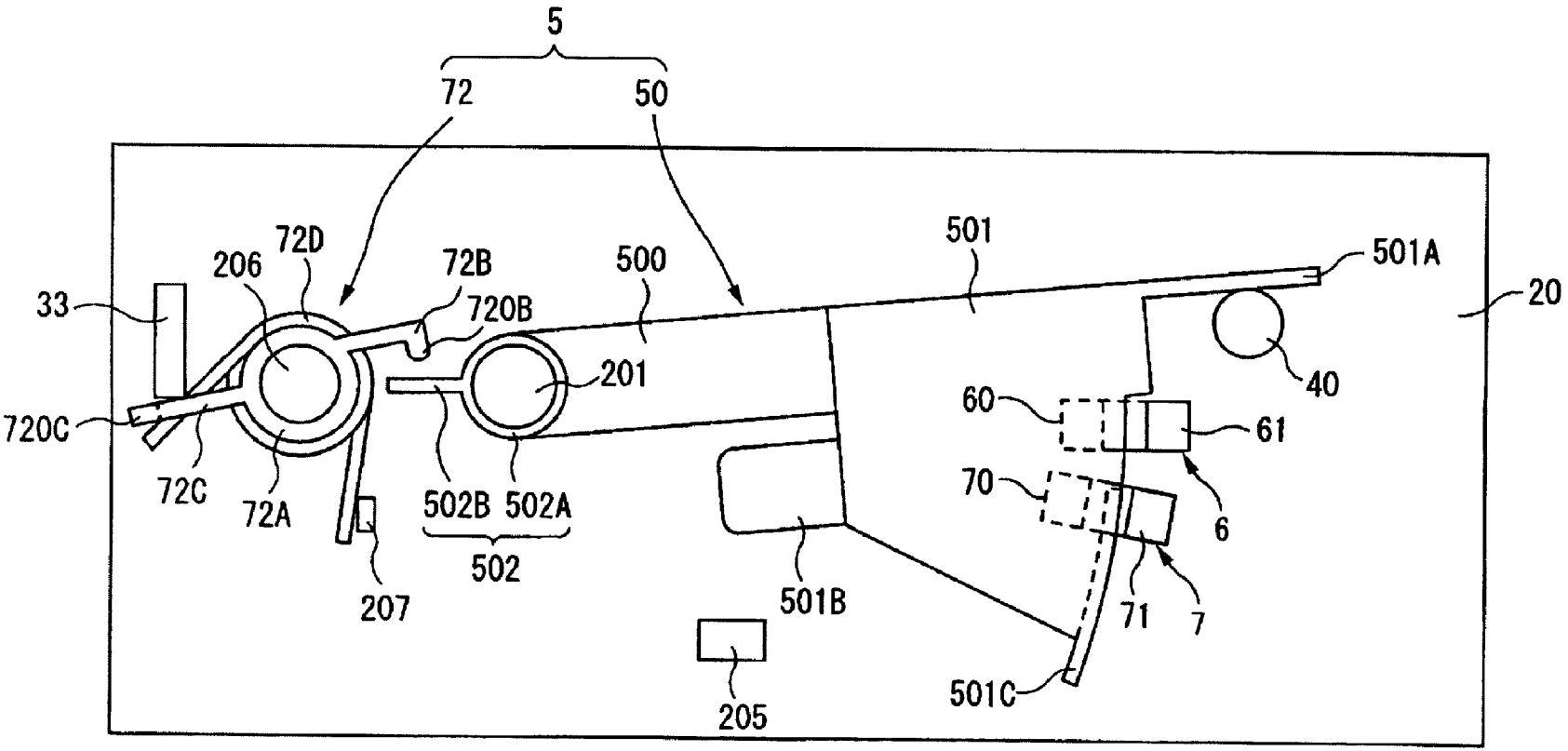
FIG. 8 is a front view illustrating the main parts of the apparatus for detecting the amount of the remaining sheets according to the second exemplary embodiment of the present invention.

Next, an apparatus for detecting the amount of the remaining sheets according to a second exemplary embodiment of the present invention will be described with reference to FIGS. 7 and 8. FIG. 7 is an exploded perspective view illustrating an entire apparatus for detecting the amount of the remaining sheets according to a second exemplary embodiment. FIG. 8 is a front view illustrating the main parts of the apparatus for detecting the amount of the remaining sheets according to the second exemplary embodiment. In FIGS. 7 and 8, the same reference numerals as the reference numerals of FIGS. 2 and 3 represent the same elements, and thus their description will be omitted.

In FIG. 7, an apparatus 71 for detecting the amount of remaining sheets according to a second exemplary embodiment is characterized in that the locking unit 72 of the link mechanism 5 is returned by the withdrawal of the sheet feeding tray 3 from the apparatus main body 2 (illustrated in FIG. 1) and is provided in the position where the locking unit 72 pressingly contacts the rotating link 50.

Therefore, as illustrated in FIG. 8, the locking unit 72 includes a locking unit main body 72A, a locking piece 72B, and a pressing force receiving piece 72C and is rotatably provided in the sheet feeding tray 3 (illustrated in FIG. 7) of the mounting plate 20 with a supporting shaft 206 interposed. The locking unit 72 is moved by the insertion of the sheet feeding tray 3 into the apparatus main body 2 and releases the locking of the rotating link 50. The locking unit 72 is returned by the withdrawal of the sheet feeding tray 3 from the apparatus main body 2 and locks the rotating link 50 in a rotation final end.

The locking unit main body 72A is provided around the supporting shaft 206. The entire locking unit main body 72A is formed of a cylindrical body.

The locking piece 72B protrudes on the external circumference of the locking unit main body 72A. A locking unit 720S for locking a rotating force receiving piece 502 of the rotating link 50 is provided in the locking piece 72B when the sheet feeding tray 3 is withdrawn from the apparatus main body 2.

The pressing force receiving piece 72C runs parallel with the locking piece 72B in a circumferential direction at a predetermined distance and protrudes above the external circumference of the locking unit main body 72A in the direction opposite to the direction in which the locking piece 72B protrudes. The pressing force receiving piece 72C receives pressing force from a pressing rib 33 due to the insertion of the sheet feeding tray 3 into the apparatus main body 2. A locking unit 720C for locking one end of a spring 72D is provided in the pressing force receiving piece 72C.

The spring 72D is formed of a torsion spring and is maintained around the supporting shaft 206. The one end is locked to the locking unit 720C and the other end is locked to the mounting plate 20 with a locking unit 207 interposed. In a state where the sheet feeding tray 3 is withdrawn from the apparatus main body 2, the spring 72D provides the elastic force in the direction where the spring 72D pressingly contacts the rotating force receiving unit 502B of the rotating force receiving piece 502 with the locking piece 72B interposed to the rotating link 50.

The rotating link 50 includes the rotating force receiving piece 502 in the link base piece 500 and is rotatably provided in the sheet feeding tray 3 of the mounting plate 20 around the supporting shaft 201. The rotating force receiving piece 502 includes a cylindrical base 502A into which the supporting shaft 201 is inserted and the rotating force receiving unit 502B that protrudes above the external circumference of the base 502A. When the sheet feeding tray 3 is withdrawn from the apparatus main body 2, the rotating force receiving unit 502B receives the elastic force of the spring 72D from the locking piece 72B.

(Operation of Apparatus 71 for Detecting Amount of Remaining Sheets)

Figure 9A:
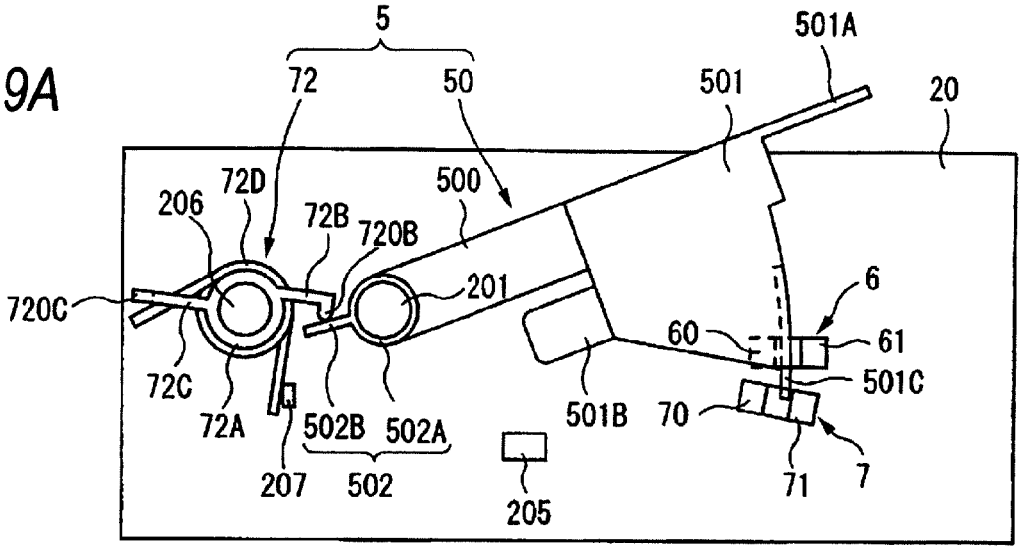
FIGS. 9A to 9C are front views illustrating the operation of the apparatus for detecting the amount of the remaining sheets according to the second exemplary embodiment of the present invention.
Figure 9B:
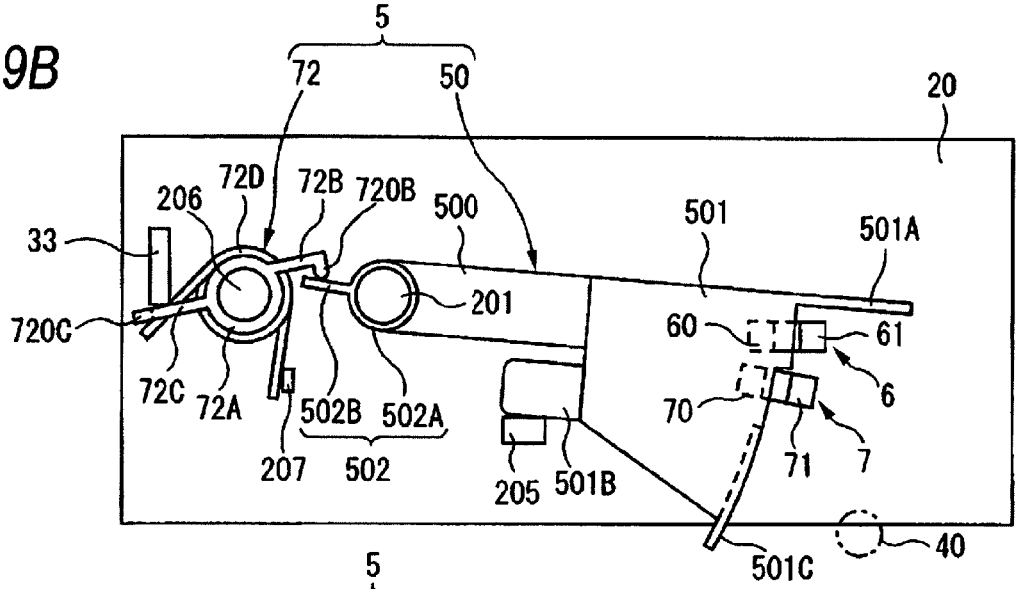
Figure 9C:
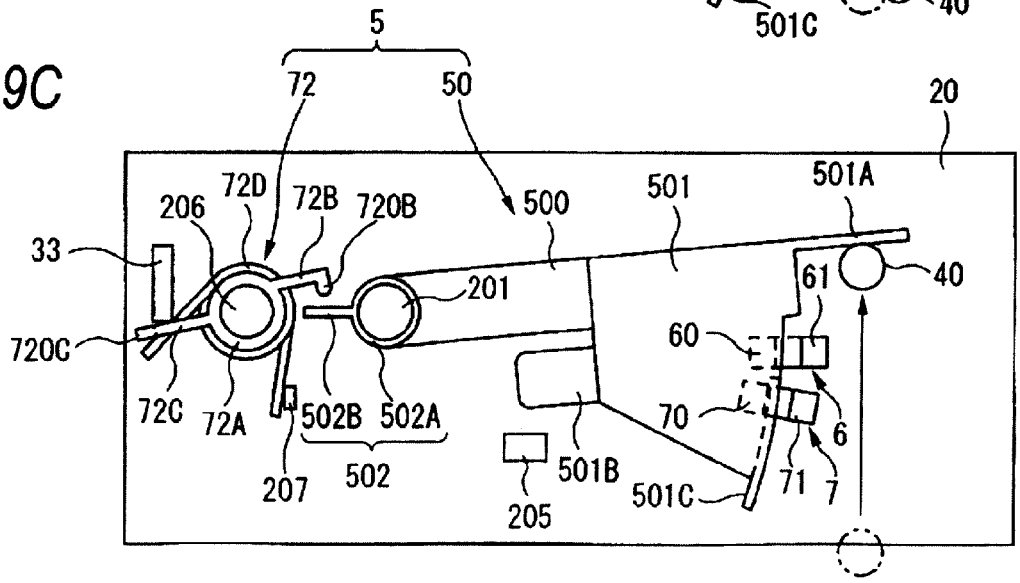

Next, the operation of the apparatus for detecting the amount of the remaining sheets according to the second exemplary embodiment of the present invention will be described with reference to FIGS. 7 and 9A to 9C. FIGS. 9A to 9C are front views illustrating the operation of the apparatus for detecting the amount of the remaining sheets according to the second exemplary embodiment. FIG. 9A illustrates a state in which the sheet feeding tray is withdrawn from the apparatus main body. FIG. 93 illustrates a state immediately after the sheet feeding tray is inserted into the apparatus main body. FIG. 9C illustrates a state in which the sheet feeding tray is inserted into the apparatus main body.

The operation of the apparatus 71 for detecting the amount of the remaining sheets according to the present exemplary embodiment is divided into the case in which the sheet feeding tray is inserted into the apparatus main body and the case in which the sheet feeding tray is withdrawn from the apparatus main body to be described.

When the sheet feeding tray 3 is withdrawn from the apparatus main body 2, as illustrated in FIG. 9A, the rotating force receiving unit 502B is locked by the locking piece 723 and the rotating link 50 is provided in the rotation final end. When the sheet feeding tray 3 is inserted into the apparatus main body 2, as illustrated in FIG. 9B, the locking of the rotating force receiving unit 502B by the locking piece 72B is released and the movement controller 501B of the rotating link 50 contacts the stopper 205 of the mounting plate 20 to be provided in the rotation starting end.

(Case in which Sheet Feeding Tray is Inserted into Apparatus Main Body)

When the sheet feeding tray 3 is inserted into the apparatus main body 2, the pressing rib 33 moves in the insertion direction together with the sheet feeding tray 3 to press the pressing force receiving piece 720 of the locking unit 72. Due to the pressure, the locking unit 72 rotates from the position illustrated in FIG. 9A around the supporting shaft 206 in a counter-clockwise direction. In this case, the locking of the rotating force receiving unit 502B by the locking piece 72B is released by the rotation of the locking unit 72. Therefore, the rotating link 50 is rotated by the deadweight around the supporting shaft 201 in the clockwise direction and is provided in the rotation starting end as illustrated in FIG. 9B.

When the sheet feeding tray 3 is inserted into the apparatus main body 2, as illustrated in FIG. 9B by a two-dot chain line, the maintaining pin 40 of the tilting plate 4 moves to be provided below the contact force receiving unit 501A of the rotating link 50 and the locking between the tilting plate 4 and the sheet feeding tray 3 by the locking unit (not shown) is released. Therefore, the tilting plate 4 is tilted from the tilting starting end to the tilting final end by the elastic force of the springs 43 and 44. Accompanying the tilting, the maintaining pin 40 rises from the position illustrated in FIG. 9C by a two-dot chain line to the position illustrated in FIG. 9C by a solid line to contact the contact force receiving unit 501A of the rotating link 50. The tilting plate 4 tilts more from the contact starting position in which the maintaining pin 40 starts to contact the contact force receiving unit 501A to the tilting final end while maintaining the contact state of the maintaining pin 40 and is provided to maintain the rotating link 50 in the tilting position in accordance with the amount of the remaining sheets in the sheet feeding tray 3.

(Case in which Sheet Feeding Tray is Withdrawn from Apparatus Main Body)

When the sheet feeding tray 3 is withdrawn from the apparatus main body 2, the pressing rib 33 moves in the withdrawal direction together with the sheet feeding tray 3. Accompanying the above, the pressing of the locking unit 72 to the pressing force receiving piece 72C by the pressing rib 33 is released and the locking unit 72 is rotated to return by the elastic force of the spring 72D. Accompanying the rotation returning operation of the locking unit 72 of the apparatus main body 2, the locking piece 72B presses the rotating force receiving piece 502B in the direction where the rotating link 50 is rotated around the supporting shaft 201 in the counter-clockwise direction. Therefore, the rotating link 50 rotates around the supporting shaft 201 in the counter-clockwise direction and is provided in the rotation final end as illustrated in FIG. 9A in a state where the rotating force receiving unit 502E is locked by the locking piece 72B. Therefore, even when one end of the sheet feeding tray 3 is withdrawn from a state in which the sheet feeding tray 3 is inserted into the insertion end (sheet feeding) position of the apparatus main body 2 to the position before the withdrawal ends, and the sheet feeding tray 3 is inserted again toward the insertion end position of the apparatus main body 2, the maintaining pin 40 of the tilting plate 4 is provided below the contact force receiving unit 501A of the rotating link 50, so that the rotating link 50 can be correctly maintained by the maintaining pin 40 and that the amount of the remaining sheets can be correctly detected.

When the sheet feeding tray 3 is withdrawn from the apparatus main body 2, the tilting plate 4 is tilted back by the cam unit (not shown) from the tilting position illustrated in FIG. 9C to the tilting starting end against the elastic force of the springs 43 and 44 and the maintaining pin 40 releases the contact between the maintaining pin 40 and the contact force receiving unit 501A of the rotating link 50 so that the maintaining pin 40 falls. When the maintaining pin 40 is caused to fall more by the tilting back of the tilting plate 4 to be provided in the returning position, the tilting plate 4 tilts back to the tilting starting end to be locked to the sheet feeding tray 3 by the locking unit (not shown).

In the apparatus 1 for detecting the amount of the remaining sheets having the above structure, since the sensors 6 and 7 for detecting the amount of the remaining sheets and the rotating link 50 are provided in the mounting plate 20 of the apparatus main body 2, like in the first exemplary embodiment, in comparison with the case in which the rotating link is mounted in the sheet feeding tray and the case in which the sensors for detecting the amount of the remaining sheets are mounted in the apparatus main body, it is possible to relax the degree of precision in the relative position between the shielding unit 501C of the rotating link 50 and the sensors 6 and 7 for detecting the amount of the remaining sheets.

Examples of the sheets used in the present invention include plain papers, thick papers (e.g. coated papers) and OHP sheets.

As described above, the image forming apparatus according to the present invention is described with reference to the exemplary embodiments. However, the present invention is not limited to the above exemplary embodiments and various changes in form and details may be made without departing from the spirit and scope of the invention. For example, the next modifications can be made.

(1) According to the above exemplary embodiments, in the state where the tray is withdrawn, the case in which the locking unit 51 locks the rotating link 50 in the rotation position corresponding to the withdrawal position of the sheet feeding tray 3 (the first exemplary embodiment) and the case in which the locking unit 72 locks the rotating link 50 in the rotation final end (the second exemplary embodiment) are described. However, the present invention is not limited to the above. A desired object can be achieved if only the locking unit (the locking member) locks the rotating link (the rotating member) in the rotation position closer to the rotation final end than the rotation position corresponding to the position in which the sheet feeding tray is withdrawn from the apparatus main body.

(2) According to the above exemplary embodiments, the case in which the sheet supplying unit 103 (the sheet feeding tray 3) is assembled in the case 101 to have one stair is described. However, the present invention is not limited to the above. The sheet supplying unit 103 can be assembled to have a plurality of stairs such as two stairs and three stairs.

(3) According to the above exemplary embodiments, the case in which the image forming apparatus is applied to the copying machine is described. However, the present invention is not limited to the above. The image forming apparatus can be applied to a facsimile and a printer, or a multifunctional machine obtained by combining at least two of a copying machine, a printer, and a facsimile.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A mechanism for detecting an amount of remaining sheets, comprising:

a sheet feeding tray to be accommodated in an apparatus main body such that the sheet feeding tray can be inserted into and withdrawn from the apparatus main body, in which sheets can be loaded in an inside of the sheet feeding tray;

a tilting plate that is tiltably provided in the sheet feeding tray so as to tilt in accordance with an amount of remaining sheets in the sheet feeding tray;

a rotating member that rotates between a starting end position and a final end position of rotation of the rotating member in association with the tilting of the tilting plate;

a locking mechanism that locks the rotation of the rotating member; and a detecting mechanism that detects the amount of the remaining sheets based on a rotation position of the rotating member between the starting end position and the final end position.

2. The mechanism according to claim 1, wherein in the locking mechanism presses the rotating member.

3. The mechanism according to claim 2, wherein the locking mechanism presses a rotation supporting point of the rotating member.

4. The mechanism according to claim 3, wherein the locking mechanism comprises:

an elastic body that is provided on a side in an axial direction of the rotation supporting point of the rotating member to press the rotation support point; and a locking unit that is reciprocally provided in the axial direction of the rotation supporting point and expands and contracts the elastic body.

5. The mechanism according to claim 4, wherein the elastic body is a coil spring.

6. The mechanism according to claim 1, wherein the locking mechanism releases locking of the rotation of the rotating member when the sheet feeding tray is mounted on the apparatus main body.

7. The mechanism according to claim 1, wherein the detecting mechanism includes at least two sensors that detect the amount of the remaining sheets.

8. An image forming apparatus, comprising:

the mechanism for detecting the amount of the remaining sheets according to claim 1.

9. A mounting plate of an image forming apparatus, the mounting plate comprising:

a rotating link that rotates between a rotation final end position to a rotation starting end position in accordance with an angle of inclination of a titling plate in a sheet feeding tray, the rotating link comprising:

a link base that is rotatably connected to the mounting plate;

a force receiving unit that contacts a maintaining pin of the tilting plate and rotates the rotating link about the link base in accordance with a force received from the maintaining pin; and a sensor that detects a rotation position of the rotating link between the rotation final end position and the rotation starting end position for determining an amount of sheets of medium in the sheet feeding tray based on the detected rotation position.

10. An image forming apparatus comprising:

a sheet feeding tray; and a mounting plate, wherein the sheet feeding tray comprises:

a tilting plate that rotates about a shaft at a first end of the tilting plate in accordance with an amount of medium in the sheet feeding tray; and a maintaining pin protruding from an edge of the tilting plate at a second end of the tilting plate opposite the first end, and wherein the mounting plate comprises:

a rotating link rotatably connected to a side wall of the mounting plate, the rotating link rotatable between a rotation final end position and a rotation starting end position in accordance with an angle of inclination of the titling plate;

a force receiving unit disposed at a distal end of the rotating link that contacts the maintaining pin and rotates the rotating link in accordance with a force received from the maintaining pin; and a sensor that detects a rotation position of the rotating link between the rotation final end position and the rotation starting end position for determining the amount of medium in the sheet feeding tray based on the detected rotation position.

11. A mechanism for detecting an amount of remaining sheets, comprising:

a sheet feeding tray to be accommodated in an apparatus main body such that the sheet feeding tray can be inserted into and withdrawn from the apparatus main body, in which sheets can be loaded in an inside of the sheet feeding tray;

a tilting plate that is tiltably provided in the sheet feeding tray so as to tilt in accordance with an amount of remaining sheets in the sheet feeding tray;

a rotating member that rotates between a starting end position and a final end position of rotation of the rotating member in association with the tilting of the tilting plate; and a detecting mechanism that detects the amount of the remaining sheets based on a rotation position of the rotating member between the starting end position and the final end position.

* * * * *